US009798260B2

(12) United States Patent
Hara et al.

(10) Patent No.: US 9,798,260 B2
(45) Date of Patent: Oct. 24, 2017

(54) DECOLORIZABLE TONER

(71) Applicant: TOSHIBA TEC KABUSHIKI KAISHA, Shinagawa-ku, Tokyo (JP)

(72) Inventors: Takafumi Hara, Shizuoka-ken (JP); Masahiro Ikuta, Shizuoka-ken (JP); Tsuyoshi Itou, Shizuoka-ken (JP); Motonari Udo, Shizuoka-ken (JP); Kazuhisa Takeda, Shizuoka-ken (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/132,953

(22) Filed: Apr. 19, 2016

(65) Prior Publication Data

US 2016/0231662 A1 Aug. 11, 2016

Related U.S. Application Data

(63) Continuation of application No. 14/208,433, filed on Mar. 13, 2014, now Pat. No. 9,366,983, which is a continuation-in-part of application No. 13/664,704, filed on Oct. 31, 2012, now Pat. No. 9,128,394.

(60) Provisional application No. 61/788,626, filed on Mar. 15, 2013, provisional application No. 61/564,087, filed on Nov. 28, 2011.

(51) Int. Cl.

| | |
|---|---|
| ***G03G 9/093*** | (2006.01) |
| ***G03G 9/13*** | (2006.01) |
| ***G03G 9/09*** | (2006.01) |

(52) U.S. Cl.

CPC ..... *G03G 9/0926* (2013.01); *G03G 9/09328* (2013.01); *G03G 9/09371* (2013.01); *G03G 9/09378* (2013.01); *G03G 9/09385* (2013.01); *G03G 9/09392* (2013.01)

(58) Field of Classification Search

CPC ..... G03G 9/0926; G03G 9/09328; G03G 9/09385; G03G 9/09392; G03G 9/09378; G03G 9/09371

See application file for complete search history.

(56) References Cited

U.S. PATENT DOCUMENTS

| | | | |
|---|---|---|---|
| 4,961,088 | A | 10/1990 | Gilliland et al. |
| 8,252,496 | B2 | 8/2012 | Kabai et al. |
| 9,128,394 | B2 | 9/2015 | Hara et al. |
| 2005/0100809 | A1 | 5/2005 | Fujino et al. |
| 2007/0141498 | A1 | 6/2007 | Umehara |
| 2009/0155700 | A1 | 6/2009 | Pang et al. |

(Continued)

FOREIGN PATENT DOCUMENTS

| | | |
|---|---|---|
| JP | 11-327201 | 11/1999 |
| JP | 2005-141144 | 6/2005 |

(Continued)

OTHER PUBLICATIONS

Final Office Action for U.S. Appl. No. 13/803,922 dated Jan. 8, 2015, 13 pages.

(Continued)

*Primary Examiner* — Thorl Chea

(74) *Attorney, Agent, or Firm* — Foley & Lardner LLP

(57) ABSTRACT

Provided is a decolorizable toner including a binder resin and colorant particles which contain a color developable compound, a color developing agent, and a decolorizing agent, and have a capsule structure coated with an outer shell, wherein the binder resin is contained in an amount of 60 to 80% by mass with respect to the total amount of the toner components.

12 Claims, 1 Drawing Sheet

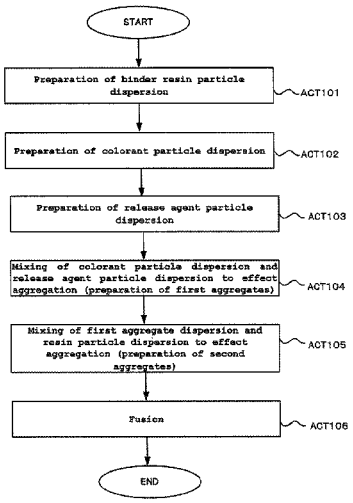

(56) References Cited

U.S. PATENT DOCUMENTS

| | | | |
|---|---|---|---|
| 2010/0055596 | A1 | 3/2010 | Okita |
| 2010/0209839 | A1 | 8/2010 | Kabai et al. |
| 2011/0033211 | A1 | 2/2011 | Matsubara et al. |
| 2011/0165509 | A1 | 7/2011 | Aoki et al. |
| 2013/0011777 | A1 | 1/2013 | Aoki et al. |
| 2013/0137031 | A1 | 5/2013 | Hara et al. |
| 2013/0196263 | A1 | 8/2013 | Asahina et al. |
| 2013/0196264 | A1 | 8/2013 | Aoki et al. |

FOREIGN PATENT DOCUMENTS

| | | | |
|---|---|---|---|
| JP | 2005-227671 | A | 8/2005 |
| JP | 2007-248533 | | 9/2007 |
| JP | 2009-145885 | | 7/2009 |
| JP | 2010-191430 | A | 9/2010 |
| JP | 2011-018046 | A | 1/2011 |
| JP | 2011-138132 | | 7/2011 |
| JP | 2013-019971 | | 1/2013 |

OTHER PUBLICATIONS

Non-Final Office Action for U.S. Appl. No. 13/803,922 Dated Jul. 31, 2014, 17 pages.

Office Action of Notification of Reason(s) for Refusal for Japanese Patent Application No. 2012-243846 Dated Sep. 9, 2014, 3 pages.

USPTO Non-final Office Action on U.S. Appl. No. 14/208,443 dated Sep. 9, 2015; 21 pages.

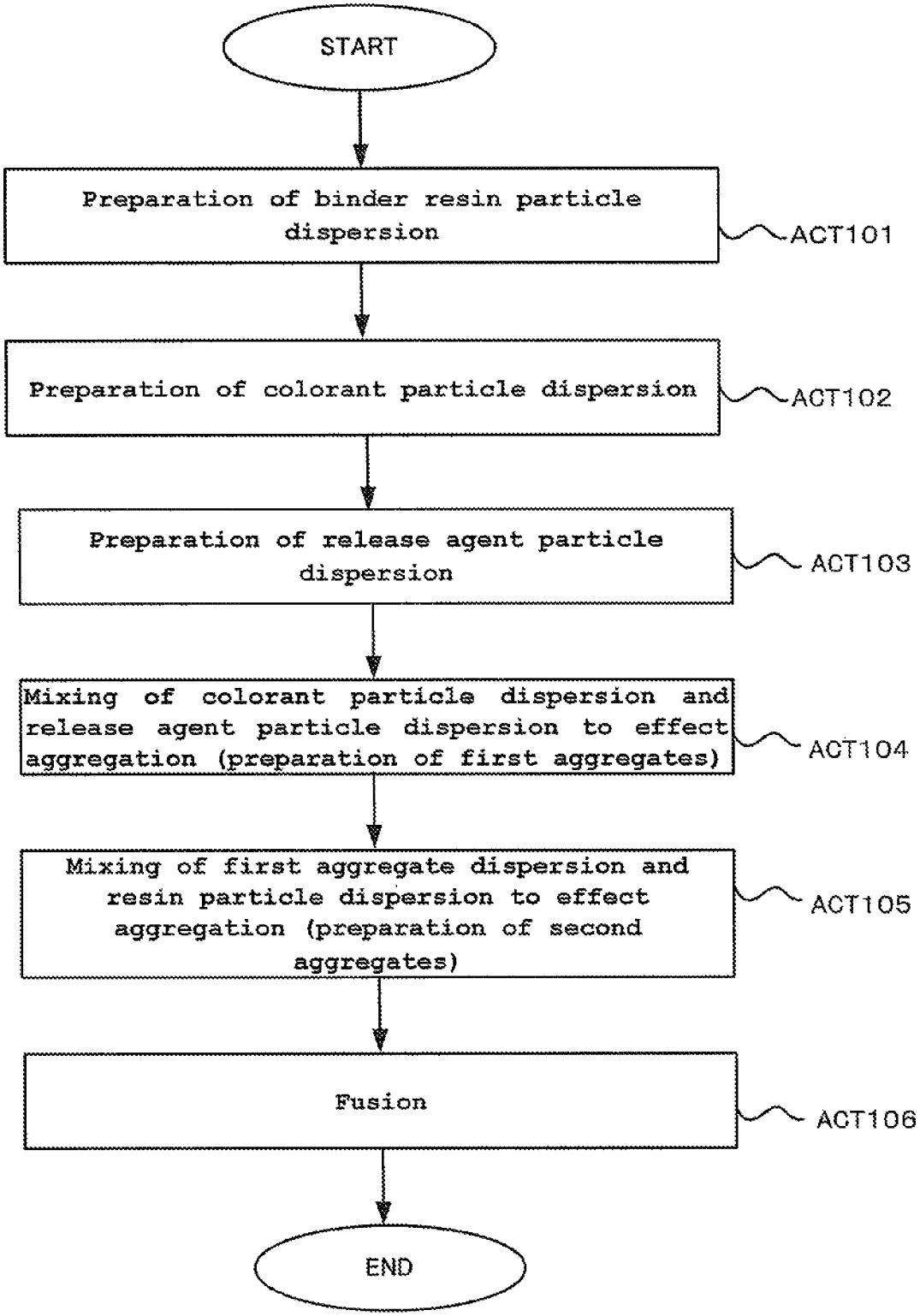
START
Preparation of binder resin particle dispersion
ACT101
Preparation of colorant particle dispersion
ACT102
Preparation of release agent particle dispersion
ACT103
Mixing of colorant particle dispersion and release agent particle dispersion to effect aggregation (preparation of first aggregates)
ACT104
Mixing of first aggregate dispersion and resin particle dispersion to effect aggregation (preparation of second aggregates)
ACT105
Fusion
ACT106
END

DECOLORIZABLE TONER

CROSS REFERENCE TO RELATED APPLICATIONS

This application is a Continuation of U.S. application Ser. No. 14/208,433 filed Mar. 13, 2014, which claims priority from U.S. Provisional Application 61/788,626 filed Mar. 15, 2013 and said U.S. application Ser. No. 14/208,433 is a Continuation-In-Part of U.S. application Ser. No. 13/664,704 filed Oct. 31, 2012, now U.S. Pat. No. 9,128,394 issued Sep. 8, 2015, which claims priority from U.S. Provisional application 61/564,087 filed Nov. 28, 2011. All of the aforesaid applications are incorporated herein by reference in their entirety.

FIELD

Embodiments described herein relate generally to a technique for a decolorizable toner.

BACKGROUND

As a method for producing a toner, there is known a production method called "aggregation method". The aggregation method is carried out according to the following procedure. First, toner components such as a binder resin, a colorant, and a release agent are aggregated using an aggregating agent such as a metal salt in a medium such as water by intentionally destroying the dispersed state of the respective particles, whereby aggregated particles are obtained. Subsequently, the obtained aggregated particles are fused by a heating treatment, whereby a toner is obtained. The fusing step and the aggregation step are sometimes performed simultaneously.

In this aggregation method, a toner is produced by, for example, aggregating particles in the nanometer order, and therefore, the particle diameter of the toner can be reduced and also the shape of the toner can be changed according to the conditions for the heating treatment for fusing the particles, and therefore, this method is very suitable as the method for producing a toner.

However, the aggregation method in the related art has a problem that, among the constituent components of the toner, a component in the form of particles having higher hydrophilicity than the binder resin or a component in the form of particles having a micron-order particle diameter is easily exposed on a toner surface.

Further, as a decolorizable colorant, there is known a colorant obtained by microencapsulation of a color developable agent including a leuco dye or the like and a color developing agent. The coloring power of a leuco dye-based material is much lower than that of a pigment, and therefore, in order to form a toner having a sufficient coloring power, it is necessary to incorporate a large amount of the colorant in the toner. However, when a toner is produced by the aggregation method using such a microencapsulated colorant, the above-described problem of exposure of the component on the toner surface or detachment of the component is liable to occur, and thus, it is not easy to incorporate a large amount of such a microencapsulated colorant in the binder resin.

DESCRIPTION OF THE DRAWING

FIG. 1 is a flow chart of a method for producing a decolorizable toner according to an embodiment.

DETAILED DESCRIPTION

Hereinafter, embodiments will be described in detail.

According to this embodiment, a decolorizable toner including a binder resin and colorant particles which contain a color developable compound, a color developing agent, and a decolorizing agent, and have a capsule structure coated with an outer shell, wherein the binder resin is contained in an amount of 60 to 80% by mass with respect to the total amount of the toner components is provided.

Hereinafter, the decolorizable toner according to this embodiment (hereinafter sometimes simply referred to as "toner according to this embodiment") will be described with reference to the accompanying drawing.

The decolorizable toner according to this embodiment contains a binder resin and colorant particles. The colorant particles contain a color developable compound, a color developing agent, and a decolorizing agent, and have a capsule structure coated with an outer shell. The toner according to this embodiment contains a binder resin in an amount of 60 to 80% by mass with respect to the total amount of the toner components. Further, the "colorant" as used herein refers to one type of compound or a composition, which imparts a color to the toner.

The toner according to this embodiment is produced by, for example, a method shown in FIG. 1. Hereinafter, a case where a release agent to be contained as needed is used will be described as an example.

First, in Act 101 to Act 103, a binder resin particle dispersion, a colorant particle dispersion, and a release agent particle dispersion are prepared.

A method for preparing the respective particle dispersions is not particularly limited and can be appropriately selected by those skilled in the art. Examples thereof may include an emulsion polymerization method, a mechanical emulsification method, a phase inversion emulsification method, and a melting emulsification method. Further, the surface of each particle produced may be microencapsulated by an interface polymerization method, an in situ polymerization method, a coacervation method, an in-liquid drying method, an in-liquid curing coating method, or the like. As a dispersion medium to be used in the preparation of the dispersion, for example, water, an alcohol such as ethanol or glycerin, a water-soluble organic solvent such as glycol ether, or the like can be used.

In this embodiment, the volume average particle diameter of the release agent particles is preferably smaller than that of the colorant particles, and the volume average particle diameter of the binder resin particles is preferably smaller than that of the release agent particles.

The volume average particle diameter of the colorant particles in the colorant particle dispersion is preferably 0.5 μm or more from the viewpoint of charge stability and storage stability of the toner, and 7 μm or less from the viewpoint of color developability of the toner. The volume average particle diameter of the colorant particles is more preferably from 0.7 μm to 5 μm.

Further, from the viewpoint of charge stability and storage stability of the toner, the volume average particle diameter of the binder resin particles in the binder resin particle dispersion is preferably from 0.01 μm to 1.0 μm, more preferably from 0.05 μm to 0.2 μm.

When the volume average particle diameter of the binder resin particles is 0.01 μm or more, the viscosity of the dispersion containing the binder resin particles and the below-described first aggregates is stabilized, and the production of the below-described first aggregates tends to be facilitated. Further, when the volume average particle diameter of the binder resin particles is 1.0 μm or less, the number of the binder resin particles in the dispersion is increased, and thus, the below-described first aggregates can be sufficiently coated therewith to stabilize the chargeability of the toner.

The "volume average particle diameter" as used herein refers to a particle diameter of a particle in the dispersion which is measured as a volume median diameter (D50) by a laser diffraction scattering method. In this embodiment, the volume average particle diameter can be measured using, for example, SALD-7000 manufactured by Shimadzu Corporation or Coulter Counter Multisizer III.

In this embodiment, as an example, as shown in FIG. 1, the binder resin particle dispersion, the colorant particle dispersion, and the release agent particle dispersion are prepared in Act 101 to Act 103, however, the order or the like of the preparation of these dispersions is not particularly limited as long as the preparation is completed before being subjected to mixing or the like. For example, in this embodiment, the preparation of the binder resin particle dispersion performed in Act 101 may be performed after forming the below-described first aggregates.

Subsequently, in Act 104, the colorant particle dispersion and the release agent particle dispersion are mixed, and the colorant particles and the release agent particles are aggregated in the obtained dispersion of the colorant particles and the release agent particles, thereby forming aggregates (hereinafter referred to as "first aggregates").

A method for forming the first aggregates obtained in Act 104 is not particularly limited, and for example, an aggregation method with the use of a metal salt or by the adjustment of pH, or a method in which the colorant particles and the release agent particles are prepared so as to have zeta potentials of opposite sign, and then mixed with one another to aggregate the colorant particles and the release agent particles can be used. In the first aggregates, the release agent particles having a volume average particle diameter smaller than that of the colorant particles are disposed outside the colorant particles.

Subsequently, in Act 105, the binder resin particle dispersion is mixed in the first aggregate dispersion obtained in Act 104, and the first aggregates and the binder resin particles are aggregated in the obtained dispersion of the first aggregates and the binder resin particles, whereby second aggregates are formed. The binder resin particles have a volume average particle diameter smaller than that of the release agent particles which are disposed outside the colorant particles in the first aggregates, and therefore are disposed outside the release agent particles. As a result, the surfaces of the first aggregates are coated with the binder resin particles.

A method for aggregating the first aggregates and the binder resin particles is not particularly limited, and for example, a hetero-aggregation method or the like can be used.

Then, in Act 106, a surfactant is added thereto as needed, and a fusing treatment by heating is performed, whereby toner particles are formed.

The fusing temperature is not particularly limited and can be appropriately determined by those skilled in the art. For example, the fusing temperature is set to a temperature equal to or higher than the glass transition temperature Tg of the binder resin. When the decolorizing temperature at which the colorant is decolorized is lower than the fusing temperature, the color is erased in the fusing step. Accordingly, it is preferred to design the colorant such that the decolorizing temperature of the colorant is higher than the fusing temperature.

When the obtained toner particles are used in a dry-type electrophotographic apparatus, a washing step, a drying step, a post-treatment step such as external addition, and the like are performed. When the obtained toner particles are used in a wet-type electrophotographic apparatus, a drying step or the like can be appropriately omitted, and a material for the purpose of adjusting the dispersion can be added as needed.

The thus produced toner has a release agent layer which is derived from the release agent particles and is disposed outside the colorant, and a binder resin layer which is derived from the binder resin particles and is disposed outside the release agent layer. That is, in the toner of this embodiment, the colorant is coated with the release agent layer and the binder resin layer disposed outside the release agent layer.

Incidentally, in the step of forming the first aggregates in Act 104, the first aggregates may contain other components such as the binder resin particles in addition to the colorant particles and the release agent particles. Specifically, the first aggregates may contain the binder resin in an amount of 15% or less with respect to the total amount of the binder resin to be contained in the toner particles. If the amount of the binder resin contained in the first aggregates exceeds 15% with respect to the total amount of the resin to be contained in the toner particles, the aggregation of the colorant particles and the release agent particles is lowered, and the coating with the binder resin particles in Act 105 tends to be insufficient as compared with the case where the amount of the binder resin contained in the first aggregates is set to 15% or less with respect to the total amount of the resin to be contained in the toner particles.

The materials which can be used in this embodiment are, for example, as follows.

Binder Resin

A resin which can be used as the binder is not particularly limited, however, a polyester resin is preferred. The polyester resin has a glass transition temperature lower than a styrene resin, and a fixing treatment can be performed at a lower temperature.

Examples of an acid component to be contained in the polyester resin include aromatic dicarboxylic acids such as terephthalic acid, phthalic acid, and isophthalic acid; and aliphatic carboxylic acids such as fumaric acid, maleic acid, succinic acid, adipic acid, sebacic acid, glutaric acid, pimelic acid, oxalic acid, malonic acid, citraconic acid, and itaconic acid.

Examples of an alcohol component to be contained in the polyester resin include aliphatic diols such as ethylene glycol, propylene glycol, 1,4-butanediol, 1,3-butanediol, 1,5-pentanediol, 1,6-hexanediol, neopentyl glycol, trimethylene glycol, trimethylolpropane, and pentaerythritol; alicyclic diols such as 1,4-cyclohexanediol and 1,4-cyclohexanedimethanol; and ethylene oxide adducts of bisphenol A or propylene oxide adducts of bisphenol A.

Further, the above-described polyester components can be converted so as to have a crosslinking structure using a trivalent or higher polyvalent carboxylic acid component or a trihydric or higher polyhydric alcohol component such as 1,2,4-benzenetricarboxylic acid (trimellitic acid) or glycerin.

It is also possible to use a mixture of two or more types of polyester resins having different compositions as the binder resin.

As the polyester resin, either a crystalline polyester resin or an amorphous polyester resin can be used.

The glass transition temperature of the polyester resin is preferably 40° C. or higher and 70° C. or lower, more preferably 45° C. or higher and 65° C. or lower from the viewpoint of storage stability and low-temperature fixability of the toner.

In this embodiment, the amount of the binder resin to be contained in the toner is preferably from 60 to 80% by mass, more preferably from 60 to 70% by mass with respect to the total amount of the toner components. According to this embodiment, even if the amount of the binder resin is reduced, the charge stability and the storage stability can be maintained. In other words, according to this embodiment, it is possible to improve the color developability and the low-temperature fixability of the toner by increasing the amounts of the colorant and the release agent while maintaining the charge stability and the storage stability.

If the amount of the binder resin is less than 60% by mass with respect to the total amount of the toner components, the colorant particles cannot be incorporated in the toner, and therefore, the charge stability is deteriorated. Meanwhile, if the amount of the binder resin exceeds 80% by mass, a large amount of heat is required for melting the binder resin when fixing the toner, and therefore, low-temperature fixability cannot be achieved. In the case of a decolorizable toner, if a difference between the decolorizing temperature of the toner and the fixing temperature of the toner is small, control for fixing the toner in a colored state is not easy due to this. Therefore, the low-temperature fixability is important for facilitating the control for fixing the toner in a colored state. Incidentally, the "total amount of the toner components" as used herein refers to the total amount of the components to be contained in the toner particles, and refers to a concept that additives and the like are excluded.

Colorant

In this embodiment, as the colorant particles, particles obtained by coating a composition containing at least a color developable compound, a color developing agent, and a decolorizing agent with an outer shell can be used. A toner containing a color developable compound and a color developing agent as a colorant can be decolorized by, for example, a decolorizing treatment such as heating. That is, since a color developable compound and a color developing agent are used as a colorant, the toner of this embodiment can be used as a decolorizable toner.

The encapsulated colorant particles can be prepared by, for example, emulsifying and dispersing components to be included in the encapsulated colorant particles such as a color developable compound, a color developing agent, and a decolorizing agent, and an encapsulating agent, and then, adding a reaction agent to cause a reaction.

The encapsulating agent (a shell material) for forming an outer shell of the colorant is not particularly limited, and can be appropriately selected by those skilled in the art, and examples thereof include an aromatic polyvalent isocyanate prepolymer.

Examples of the components to be included in the encapsulated colorant particles include a material susceptible to the effect of an additive of the toner and a material which is not desired to be let out of the toner during the production. Examples of such a material include a color developable compound which can be reversibly colored and decolorized by a reaction with a color developing agent and is typified by a leuco dye, a color developing agent, and a decolorizing agent which controls this coloration and decolorization function by the reaction between the color developing agent and the color developable compound. By including these materials in a microcapsule, the coloration and decolorization reaction is hardly inhibited by an additive of the toner. In addition, according to this configuration, since the coloration and decolorization reaction occurs inside the capsule, the decolorization process by heating promptly proceeds, and thus, decolorization can be promptly carried out.

The color developable compound is an electron donating compound which accepts a proton from the color developing agent when coupled therewith. In this embodiment, the color developable compound is not particularly limited and can be appropriately selected by those skilled in the art, however, for example, a leuco dye can be used. Examples of the leuco dye include diphenylmethane phthalides, phenylindolyl phthalides, indolyl phthalides, diphenylmethane azaphthalides, phenylindolyl azaphthalides, fluorans, styrynoquinolines, and diaza-rhodamine lactones.

Specific examples thereof include 3,3-bis(p-dimethylaminophenyl)-6-dimethylaminophthalide, 3-(4-diethylaminophenyl)-3-(1-ethyl-2-methylindol-3-yl)phthalide, 3,3-bis(1-n-butyl-2-methylindol-3-yl)phthalide, 3,3-bis(2-ethoxy-4-diethylaminophenyl)-4-azaphthalide, 3-(2-ethoxy-4-diethylaminophenyl)-3-(1-ethyl-2-methylindol-3-yl)-4-azaphthalide, 3-[2-ethoxy-4-(N-ethylanilino)phenyl]-3-(1-ethyl-2-methylindol-3-yl)-4-azaphthalide, 3,6-diphenylaminofluoran, 3,6-dimethoxyfluoran, 3,6-di-n-butoxyfluoran, 2-methyl-6-(N-ethyl-N-p-tolylamino)fluoran, 2-N,N-dibenzylamino-6-diethylaminofluoran, 3-chloro-6-cyclohexylaminofluoran, 2-methyl-6-cyclohexylaminofluoran, 2-(2-chloroanilino)-6-di-n-butylaminofluoran, 2-(3-trifluoromethylanilino)-6-diethylaminofluoran, 2-(N-methylanilino)-6-(N-ethyl-N-p-tolylamino)fluoran, 1,3-dimethyl-6-diethylaminofluoran, 2-chloro-3-methyl-6-diethylaminofluoran, 2-anilino-3-methyl-6-diethylaminofluoran, 2-anilino-3-methyl-6-di-n-butylaminofluoran, 2-xylidino-3-methyl-6-diethylaminofluoran, 1,2-benz-6-diethylaminofluoran, 1,2-benz-6-(N-ethyl-N-isobutylamino)fluoran, 1,2-benz-6-(N-ethyl-N-isoamylamino)fluoran, 2-(3-methoxy-4-dodecoxystyryl)quinoline, spiro[5H-(1)benzopyrano(2,3-d)pyrimidine-5,1'(3'H)isobenzofuran]-3'-one, 2-(diethylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-methyl-, spiro[5H-(1)benzopyrano(2,3-d)pyrimidine-5,1'(3'H)isobenzofuran]-3'-one, 2-(di-n-butylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(N-ethyl-N-i-amylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)4-phenyl, 3-(2-methoxy-4-dimethylaminophenyl)-3-(1-butyl-2-methylindol-3-yl)-4,5,6,7-tetrachlorophthalide, 3-(2-ethoxy-4-diethylaminophenyl)-3-(1-ethyl-2-methylindol-3-yl)-4,5,6,7-tetrachlorophthalide, and 3-(2-ethoxy-4-diethylaminophenyl)-3-(1-pentyl-2-methylindol-3-yl)-4,5,6,7-tetrachlorophthalide. In addition, examples thereof include pyridine compounds, quinazoline compounds, and bisquinazoline compounds. These compounds may be used by mixing two or more types thereof.

The color developing agent is an electron accepting compound which donates a proton to the color developable compound such as a leuco dye. Examples of the color developing agent include phenols, metal salts of phenols, metal salts of carboxylic acids, aromatic carboxylic acids, aliphatic carboxylic acids having 2 to 5 carbon atoms, benzophenones, sulfonic acids, sulfonates, phosphoric acids, metal salts of phosphoric acids, acidic phosphoric acid esters, metal salts of acidic phosphoric acid esters, phosphorous acids, metal salts of phosphorous acids, monophenols, polyphenols, 1,2,3-triazole, and derivatives thereof. Additional examples thereof include those having, as a substituent, an alkyl group, an aryl group, an acyl group, an alkoxycarbonyl group, a carboxy group or an ester thereof, an amide group, a halogen group, or the like, and bisphenols, trisphenols, phenol-aldehyde condensed resins, and metal salts thereof. These compounds may be used by mixing two or more types thereof.

Specific examples of the color developing agent include phenol, o-cresol, tertiary butyl catechol, nonylphenol, n-octylphenol, n-dodecylphenol, n-stearylphenol, p-chlorophenol, p-bromophenol, o-phenylphenol, n-butyl p-hydroxybenzoate, n-octyl p-hydroxybenzoate, benzyl p-hydroxybenzoate, dihydroxybenzoic acid and esters thereof (such as 2,3-dihydroxybenzoic acid and methyl 3,5-dihydroxybenzoate), resorcinol, gallic acid, dodecyl gallate, ethyl gallate, butyl gallate, propyl gallate, 2,2-bis(4-hydroxyphenyl)propane, 4,4-dihydroxydiphenylsulfone, 1,1-bis(4-hydroxyphenyl)ethane, 2,2-bis(4-hydroxy-3-methylphenyl)propane, bis(4-hydroxyphenyl)sulfide, 1-phenyl-1,1-bis(4-hydroxyphenyl)ethane, 1,1-bis(4-hydroxyphenyl)-3-methylbutane, 1,1-bis(4-hydroxyphenyl)-2-methylpropane, 1,1-bis(4-hydroxyphenyl)n-hexane, 1,1-bis(4-hydroxyphenyl)n-heptane, 1,1-bis(4-hydroxyphenyl)n-octane, 1,1-bis(4-hydroxyphenyl)n-nonane, 1,1-bis(4-hydroxyphenyl)n-decane, 1,1-bis(4-hydroxyphenyl)n-dodecane, 2,2-bis(4-hydroxyphenyl)butane, 2,2-bis(4-hydroxyphenyl)ethyl propionate, 2,2-bis(4-hydroxyphenyl)-4-methylpentane, 2,2-bis(4-hydroxyphenyl)hexafluoropropane, 2,2-bis(4-hydroxyphenyl)n-heptane, 2,2-bis(4-hydroxyphenyl)n-nonane, 2,4-dihydroxyacetophenone, 2,5-dihydroxyacetophenone, 2,6-dihydroxyacetophenone, 3,5-dihydroxyacetophenone, 2,3,4-trihydroxyacetophenone, 2,4-dihydroxybenzophenone, 4,4'-dihydroxybenzophenone, 2,3,4-trihydroxybenzophenone, 2,4,4'-trihydroxybenzophenone, 2,2',4,4'-tetrahydroxybenzophenone, 2,3,4,4'-tetrahydroxybenzophenone, 2,4'-biphenol, 4,4'-biphenol, 4-[(4-hydroxyphenyl)methyl]-1,2,3-benzenetriol, 4-[(3,5-dimethyl-4-hydroxyphenyl)methyl]-1,2,3-benzenetriol, 4,6-bis[(3,5-dimethyl-4-hydroxyphenyl)methyl]-1,2,3-benzenetriol, 4,4'-[1,4-phenylenebis(1-methylethylidene)bis(benzene-1,2,3-triol)], 4,4'-[1,4-phenylenebis(1-methylethylidene)bis(1,2-benzenediol)], 4,4',4"-ethylidenetrisphenol, 4,4'-(1-methylethylidene)bisphenol, and methylenetris-p-cresol. These compounds may be used by mixing two or more types thereof.

Further, in this embodiment, a decolorizing agent is contained in the colorant particles along with the color developable compound and the color developing agent.

In a three-component system including a leuco dye (a color developable compound), a color developing agent, and a decolorizing agent, the decolorizing agent is a material which inhibits the coloration reaction between the leuco dye and the color developing agent by heat, and in this embodiment, a known material can be used. As the decolorizing agent, particularly, a material which can form a coloration and decolorization mechanism utilizing the temperature hysteresis of a decolorizing agent disclosed in JP-A-60-264285, JP-A-2005-1369, or JP-A-2008-280523 has an excellent instantaneous erasing property. When a mixture of such a three-component system in a colored state is heated to a specific decolorizing temperature Th or higher, the mixture can be decolorized. Even if the decolorized mixture is cooled to a temperature equal to or lower than Th, the decolorized state is maintained. When the temperature of the mixture is further decreased, the coloration reaction between the leuco dye and the color developing agent is restored at a specific color restoring temperature Tc or lower, and the mixture returns to a colored state. In this manner, it is possible to cause a reversible coloration and decolorization reaction. In particular, it is preferred that the decolorizing agent satisfies the following relationship: Th>Tr>Tc, wherein Tr represents room temperature. Examples of the decolorizing agent capable of causing this temperature hysteresis include alcohols, esters, ketones, ethers, and acid amides. Particularly, esters are preferred. Specific examples thereof include esters of carboxylic acids containing a substituted aromatic ring, esters of carboxylic acids containing an unsubstituted aromatic ring with aliphatic alcohols, esters of carboxylic acids containing a cyclohexyl group in a molecule, esters of fatty acids with unsubstituted aromatic alcohols or phenols, esters of fatty acids with branched aliphatic alcohols, esters of dicarboxylic acids with aromatic alcohols or branched aliphatic alcohols, dibenzyl cinnamate, heptyl stearate, didecyl adipate, dilauryl adipate, dimyristyl adipate, dicetyl adipate, distearyl adipate, trilaurin, trimyristin, tristearin, dimyristin, and distearin. These compounds may be used by mixing two or more types thereof. It is preferred to use such a decolorizing agent in an amount of 1 to 500 parts by mass, particularly 4 to 99 parts by mass with respect to 1 part by mass of the leuco dye. The toner of this embodiment can be decolorized by heating even when the decolorizing agent is not contained, however, by incorporating the decolorizing agent, the decolorizing treatment can be more promptly carried out.

Further, the encapsulated colorant may include another component such as a resin in addition to the color developable compound, the color developing agent, and the decolorizing agent.

The amount of the colorant to be contained in the toner is preferably 10% by mass or more, more preferably 15% by mass or more with respect to the total amount of the toner components.

Release Agent

Examples of the release agent to be contained in the release agent particles include aliphatic hydrocarbon waxes such as low-molecular weight polyethylenes, low-molecular weight polypropylenes, polyolefin copolymers, polyolefin waxes, paraffin waxes, and Fischer-Tropsch wax and modified substances thereof; vegetable waxes such as candelilla wax, carnauba wax, Japan wax, jojoba wax, and rice wax; animal waxes such as bees wax, lanolin, and spermaceti wax; mineral waxes such as montan waxes, ozokerite, and ceresin; fatty acid amides such as linoleic acid amide, oleic acid amide, and lauric acid amide; functional synthetic waxes; and silicone-based waxes. When a polyester resin is used as the binder resin, from the viewpoint of low-temperature fixability and immiscibility, an aliphatic hydrocarbon wax such as a paraffin wax is preferred. When the release agent is contained in the toner, the amount thereof is not particularly limited, but is preferably 10% by mass or more with respect to the total amount of the toner components.

Charge Control Agent

In this embodiment, other than the binder resin, the colorant, and the decolorizing agent, another component such as a charge control agent may be contained so as to make the amount 100. As the charge control agent, a metal-containing azo compound is used, and a complex or a complex salt, in which the metal element is iron, cobalt, or chromium, or a mixture thereof is preferred. A metal-containing salicylic acid derivative compound is also used, and a complex or a complex salt, in which the metal element is zirconium, zinc, chromium, or boron, or a mixture thereof is preferred.

A method for adding such a charge control agent to the toner is not particularly limited, but for example, the charge control agent can be added to the toner by being mixed with the binder resin particles in the dispersion when the binder resin particle dispersion is prepared.

Aggregating Agent

An aggregating agent which can be used in this embodiment is not particularly limited, and a monovalent metal salt such as sodium chloride, a polyvalent metal salt such as magnesium sulfate or aluminum sulfate, a non-metal salt such as ammonium chloride or ammonium sulfate, an acid such as hydrochloric acid or nitric acid, or a strong cationic coagulant such as polyamine or polyDADMAC can be appropriately used.

Surfactant

In this embodiment, a surfactant can be used as needed. The surfactant is not particularly limited, and for example, an anionic surfactant such as a sulfate ester salt-based, sulfonate salt-based, phosphate ester-based, or fatty acid salt-based surfactant, a cationic surfactant such as an amine salt-based or quaternary ammonium salt-based surfactant, an amphoteric surfactant such as a betaine-based surfactant, a nonionic surfactant such as a polyethylene glycol-based, alkylphenol ethylene oxide adduct-based, or polyhydric alcohol-based surfactant, or a polymeric surfactant such as polycarboxylic acid can be appropriately used. In general, such a surfactant is added for the purpose of imparting dispersion stability such as stability of aggregated particles, however, a surfactant of opposite polarity or the like may be used as an aggregating agent.

pH Adjusting Agent

In this embodiment, a pH adjusting agent for controlling the pH in the system can be used as needed. The pH adjusting agent is not particularly limited, and for example, a basic compound such as sodium hydroxide, potassium hydroxide, or an amine compound can be appropriately used as an alkali, and an acidic compound such as hydrochloric acid, nitric acid, or sulfuric acid can be appropriately used as an acid.

The toner of this embodiment is, for example, filled in a toner cartridge, which is mounted on an image forming apparatus such as an MFP (multifunctional peripheral), and is used in the formation of an image. Further, when the toner is used in a dry-type electrophotographic apparatus, the toner is mounted on, for example, an electrophotographic apparatus as a non-magnetic one-component developer or two-component developer, and can be used in the formation of an image on a recording medium. When the toner is used in a two-component developer, a carrier which can be used is not particularly limited and can be appropriately selected by those skilled in the art. When the toner is used in a wet-type electrophotographic apparatus, the toner is mounted on an image forming apparatus as a dispersion in which the toner is dispersed in a carrier liquid, and can be used in the formation of an image on a recording medium in the same manner as in the dry-type electrophotographic apparatus.

In an image formation process, a toner image formed using the toner of this embodiment transferred onto a recording medium is heated at a fixing temperature, and the resin is melted to penetrate in the recording medium. Then, the resin is solidified, whereby an image is formed on the recording medium (fixing treatment).

The image formed on the recording medium can be erased by performing a decolorizing treatment of the toner. Specifically, the decolorizing treatment can be performed as follows. The recording medium having an image formed thereon is heated at a heating temperature equal to or higher than the decolorizing temperature, whereby the color developable compound and the color developing agent coupled with each other can be decoupled from each other.

Hereinafter, the embodiment will be more specifically described by showing Examples, however, the invention is not limited to the Examples.

EXAMPLE 1

Preparation of Binder Resin Particle Dispersion 1

A dispersion obtained by mixing 30 parts by mass of a polyester resin (acid value: 10 mgKOH/g, Mw: 15000, Tg: 58° C.), 1 part by mass of sodium dodecylbenzene sulfonate (Neopelex G-15, manufactured by Kao Corporation) and 69 parts by mass of ion exchanged water and adjusting the pH to 12 with potassium hydroxide was placed in a high-pressure homogenizer NANO 3000 (manufactured by Beryu Co., Ltd.), and processed at 180° C. and 150 MPa, whereby a binder resin particle dispersion 1 was obtained. The volume average particle diameter of the thus obtained dispersion was measured using SALD-7000 manufactured by Shimadzu Corporation, and it was found that the dispersion had a volume average particle diameter of 0.1 μm and a sharp particle size distribution with a standard deviation of 0.15.

Preparation of Binder Resin Particle Dispersion 2

A dispersion obtained by mixing 30 parts by mass of a polyester resin (acid value: 10 mgKOH/g, Mw: 13000, Tg: 53° C.), 1 part by mass of sodium dodecylbenzene sulfonate (Neopelex G-15, manufactured by Kao Corporation) and 69 parts by mass of ion exchanged water and adjusting the pH to 12 with potassium hydroxide was placed in a high-pressure homogenizer NANO 3000 (manufactured by Beryu Co., Ltd.), and processed at 180° C. and 150 MPa, whereby a binder resin particle dispersion 2 was obtained. The volume average particle diameter of the thus obtained dispersion was measured using SALD-7000 manufactured by Shimadzu Corporation, and it was found that the dispersion had a volume average particle diameter of 0.12 μm and a sharp particle size distribution with a standard deviation of 0.15.

Preparation of Colorant Particle Dispersion

Components including 2 parts by mass of 3-(4-diethylamino-2-hexyloxyphenyl)-3-(1-ethyl-2-methylindol-3-yl)-4-azaphthalide as a leuco dye, 4 parts by mass of 1,1-bis(4'-hydroxyphenyl)hexafluoropropane and 4 parts by mass of 1,1-bis(4'-hydroxyphenyl)-n-decane as color developing agents, and 50 parts by mass of 4-benzyloxyphenylethyl caprylate as a decolorizing agent were uniformly dissolved by heating. To the obtained mixture, 30 parts by mass of an aromatic polyvalent isocyanate prepolymer and 40 parts by mass of ethyl acetate were mixed therein as encapsulating agents. The obtained solution was emulsified and dispersed in 300 parts by mass of an aqueous solution of 8% polyvinyl alcohol, and the resulting dispersion was kept stirred at 70° C. for about 1 hour. Thereafter, 2.5 parts by mass of a water-soluble aliphatic modified amine was added thereto as a reaction agent, and stirring was further continued for an additional 6 hours, whereby colorless capsule particles were obtained. Then, the resulting capsule particle dispersion was placed in a freezer (−30° C.) to develop a color, and ion exchanged water was added thereto, whereby a microcapsule particle dispersion containing 27 wt % of the colorant effective components (solid content concentration) was obtained. The obtained particle dispersion was measured using SALD-7000 manufactured by Shimadzu Corporation and found to have a volume average particle diameter of 2.5 μm.

Preparation of Release Agent Particle Dispersion

A dispersion obtained by mixing 40 parts by mass of carnauba wax, 1 part by mass of dipotassium alkenyl sulfosuccinate (LATEMUL ASK, manufactured by Kao Corporation), and 59 parts by mass of ion exchanged water was placed in a rotor-stator homogenizer CLEAR MIX 2.2S (manufactured by M Technique Co., Ltd.), and the temperature of the dispersion was increased to 100° C. while stirring at 1000 rpm, whereby a release agent particle dispersion was obtained. The volume average particle diameter of the obtained dispersion was measured using SALD-7000 manufactured by Shimadzu Corporation and found to be 0.5 μm.

Production of Toner

42 Parts by mass of the colorant particle dispersion and 63 parts by mass of ion exchanged water were mixed, and 50 parts by mass of a 30% ammonium sulfate solution was added thereto while stirring, and the resulting mixture was maintained as such for 1 hour. Then, 14 parts by mass of the release agent particle dispersion was added thereto, and the temperature of the mixture was increased to 30° C., whereby a dispersion of aggregates having a volume average particle diameter of 6.2 μm was prepared.

Further, 300 parts by mass of the binder resin particle dispersion 1 in which the solid content concentration was adjusted to 15% was gradually added thereto over 10 hours. After completion of the addition, the temperature of the resulting mixture was increased to 60° C., and as a surfactant, 5 parts by mass of a polycarboxylic acid-based surfactant (POISE 520, manufactured by Kao Corporation) was added thereto, and then, the resulting mixture was heated to 65° C. and left as such, whereby a toner dispersion was obtained. The obtained toner dispersion was subjected to washing by alternately repeating filtration and washing with ion exchanged water until the electrical conductivity of the filtrate was decreased to 50 μS/cm. Thereafter, the resulting residue was dried using a vacuum dryer until the water content therein was decreased to 1.0% by mass or less, whereby a toner of Example 1 was obtained. The volume average particle diameter of the thus obtained toner particles was measured using Coulter Counter Multisizer III and found to be 8 μm.

EXAMPLE 2

A toner was obtained in the same manner as in Example 1 except that 33 parts by mass of the colorant particle dispersion, 6 parts by mass of the release agent particle dispersion, and 280 parts by mass of the binder resin particle dispersion 1 in which the solid content concentration was adjusted to 15% were used, and the rotation speed when stirring was adjusted so that the volume average particle diameter of the toner particles was 8 μm.

COMPARATIVE EXAMPLE 1

A toner was obtained in the same manner as in Example 1 except that 30 parts by mass of the colorant particle dispersion and 6.5 parts by mass of the release agent particle dispersion were used, and the rotation speed was adjusted so that the volume average particle diameter of the toner particles was 8 μm.

EXAMPLE 3

A toner was obtained in the same manner as in Example 1 except that 28 parts by mass of the release agent particle dispersion and 260 parts by mass of the binder resin particle dispersion 1 in which the solid content concentration was adjusted to 15% were used, and the rotation speed was adjusted so that the volume average particle diameter of the toner particles was 8 μm.

EXAMPLE 4

A toner was obtained in the same manner as in Example 1 except that 25 parts by mass of the colorant particle dispersion, 30 parts by mass of the release agent particle dispersion, and 310 parts by mass of the binder resin particle dispersion 1 in which the solid content concentration was adjusted to 15% were used, and the rotation speed was adjusted so that the volume average particle diameter of the toner particles was 8 μm.

EXAMPLE 5

A toner was obtained in the same manner as in Example 1 except that 22 parts by mass of the colorant particle dispersion and 15 parts by mass of the release agent particle dispersion were used, and the rotation speed was adjusted so that the volume average particle diameter of the toner particles was 8 μm.

EXAMPLE 6

A toner was obtained in the same manner as in Example 1 except that 20 parts by mass of the colorant particle dispersion and 15 parts by mass of the release agent particle dispersion were used, and the rotation speed was adjusted so that the volume average particle diameter of the toner particles was 8 μm.

COMPARATIVE EXAMPLE 2

A toner was obtained in the same manner as in Example 1 except that 55 parts by mass of the colorant particle dispersion and 40 parts by mass of the release agent particle dispersion were used, and the rotation speed was adjusted so that the volume average particle diameter of the toner particles was 8 μm.

EXAMPLE 7

A toner was obtained in the same manner as in Example 1 except that 34 parts by mass of the release agent particle dispersion and 260 parts by mass of the binder resin particle dispersion 1 in which the solid content concentration was adjusted to 15% were used, and the rotation speed was adjusted so that the volume average particle diameter of the toner particles was 8 μm.

EXAMPLE 8

A toner was obtained in the same manner as in Example 1 except that the binder resin particle dispersion 2 in which the solid content concentration was adjusted to 15% was used, and the rotation speed was adjusted so that the volume average particle diameter of the toner particles was 8 μm.

EXAMPLE 9

A toner was obtained in the same manner as in Example 2 except that the binder resin particle dispersion 2 in which the solid content concentration was adjusted to 15% was used, and the rotation speed was adjusted so that the volume average particle diameter of the toner particles was 8 μm.

EXAMPLE 10

42 Parts by mass of the colorant particle dispersion, 63 parts by mass of ion exchanged water, 14 parts by mass of the release agent particle dispersion, and 150 parts by mass of the binder resin particle dispersion 1 in which the solid content concentration was adjusted to 15% were mixed, and the temperature of the mixture was increased to 30° C. while stirring. Then, 25 parts by mass of a 30% ammonium sulfate solution was added thereto, and the resulting mixture was maintained as such for 5 hours, whereby a dispersion of core particle aggregates having a size of 7 μm was obtained. Subsequently, 150 parts by mass of the binder resin particle dispersion 1 in which the solid content concentration was adjusted to 15% was gradually added thereto over 5 hours, whereby a dispersion of capsule particles having a core-shell structure with a size of 8 μm was obtained. Then, the temperature of the obtained dispersion was increased to 60° C., and as a surfactant, 5 parts by mass of a polycarboxylic acid-based surfactant (POISE 520, manufactured by Kao Corporation) was added thereto, and then, the resulting mixture was heated to 65° C. and kept as such, whereby a toner dispersion was obtained. The obtained toner dispersion was subjected to washing by alternately repeating filtration and washing with ion exchanged water until the electrical conductivity of the filtrate was decreased to 50 μS/cm. Thereafter, the resulting residue was dried using a vacuum dryer until the water content therein was decreased to 1.0% by mass or less, whereby a toner was obtained. The volume average particle diameter of the thus obtained toner particles was 8 μm. Further, it was observed by SEM that the colorant was exposed on the toner surface.

COMPARATIVE EXAMPLE 3

A toner having a volume average particle diameter of 8 μm was obtained in the same manner as in Example 10 except that 30 parts by mass of the colorant particle dispersion and 6.5 parts by mass of the release agent particle dispersion were used. Further, it was observed by SEM that the colorant was exposed on the toner surface.

The compositional ratios of the toners of Examples 1 to 10 and Comparative Examples 1 to 3 are shown in Table 1.

TABLE 1

| | Compositional ratio | | |
|---|---|---|---|
| | Colorant (mass %) | Release agent (mass %) | Binder resin (mass %) |
| Example 1 | 18.3 | 9.0 | 72.7 |
| Example 2 | 16.7 | 4.5 | 78.8 |
| Comparative Example 1 | 14.5 | 4.7 | 80.8 |
| Example 3 | 18.4 | 18.2 | 63.4 |
| Example 4 | 10.3 | 18.4 | 71.3 |
| Example 5 | 10.4 | 10.5 | 79.0 |
| Example 6 | 9.6 | 10.6 | 79.8 |
| Comparative Example 2 | 19.6 | 21.1 | 59.3 |
| Example 7 | 17.7 | 21.3 | 61.0 |
| Example 8 | 18.3 | 9.0 | 72.7 |
| Example 9 | 16.7 | 4.5 | 78.8 |
| Example 10 | 18.3 | 9.0 | 72.7 |
| Comparative Example 3 | 14.5 | 4.7 | 80.8 |

Each toner was evaluated as follows.

Evaluation Method for Charge Stability

With respect to 100 parts by mass of each toner, 2 parts by mass of hydrophobic silica and 0.5 parts by mass of titanium oxide were attached to the surface of the toner, and then, the toner and a ferrite carrier coated with a silicone resin were mixed so that the concentration of the toner was 8% by mass, whereby a developer was prepared.

Each of the thus prepared developer was placed in an MFP (e-Studio 356) manufactured by Toshiba Tec Corporation, and in a normal temperature and normal humidity environment, a text image was formed on 10000 sheets and output. A change in charge amount (−q/m) was measured at every 2000 sheets during the formation of the text image on 10000 sheets and evaluated. The measurement of the charge amount was performed using a powder charge amount measuring device TYPE TB-203 (manufactured by Kyocera, Inc.). The evaluation was performed according to the following criteria.

Good: The charge retention (initial charge amount/charge amount after forming the text image on 10000 sheets) is 95% or more, and no fogging is observed on the image.

Slightly poor: The charge retention (initial charge amount/charge amount after forming the text image on 10000 sheets) is 95% or more, and slight fogging is observed on the image.

Poor: The charge retention is less than 95%, and conspicuous fogging is observed.

Evaluation Method for Low-Temperature Fixability and Decolorizing Temperature

With respect to 100 parts by mass of each toner, 2 parts by mass of hydrophobic silica and 0.5 parts by mass of titanium oxide were attached as additives to the surface of the toner, and then, the toner and a ferrite carrier coated with a silicone resin were mixed so that the concentration of the toner was 8% by mass, whereby a developer was prepared.

Each of the thus prepared developer was placed in an MFP (e-Studio 356) manufactured by Toshiba Tec Corporation, which was modified so that an unfixed image can be collected, and in a normal temperature and normal humidity environment, a solid image was formed on a sheet having a basis weight of 80 g/m$^2$ such that a toner deposition amount was 0.5 mg/cm$^2$ and collected. The collected image was fixed at a paper feed rate of 30 mm/sec in a fixing device which was modified so that a fixing temperature can be freely changed, and the lowest temperature at which the image can be fixed was defined as the lowest fixing temperature. Further, the temperature at which the image density was decreased to less than 0.5 or a decolorized spot was generated was defined as the decolorizing temperature. The evaluation was performed according to the following criteria wherein ΔT was defined as follows: ΔT=(decolorizing temperature)−(lowest fixing temperature).

Very good: ΔT is 20° C. or more.

Good: ΔT is 10° C. or more and less than 20° C.

Poor: ΔT is less than 10° C.

Measurement Method for Image Density

With respect to 100 parts by mass of each toner, 2 parts by mass of hydrophobic silica and 0.5 parts by mass of titanium oxide were attached to the surface of the toner, and then, the toner and a ferrite carrier coated with a silicone resin were mixed so that the concentration of the toner was 8% by mass, whereby a developer was prepared.

Each of the thus prepared developer was placed in an MFP (e-Studio 356) manufactured by Toshiba Tec Corporation, which was modified so that an unfixed image can be collected, and in a normal temperature and normal humidity environment, a solid image was formed on a sheet having a basis weight of 80 g/m$^2$ such that a toner deposition amount was 0.5 mg/cm$^2$ and collected. The collected image was fixed at a paper feed rate of 30 mm/sec in a fixing device which was modified so that a fixing temperature can be freely changed. Then, the image density in the portion where the solid image was formed when fixing was performed at the lowest temperature at which the image can be fixed was measured using a Macbeth densitometer. The evaluation of the image density was performed according to the following criteria.

Very good: The image density is 0.65 or more.

Good: The image density is 0.45 or more and less than 0.65.

Slightly poor: The image density is less than 0.45.

Evaluation Method for Storage Stability

With respect to 100 parts by mass of each toner, 2 parts by mass of hydrophobic silica and 0.5 parts by mass of titanium oxide were attached to the surface of the toner, whereby an externally added toner was prepared. The thus prepared externally added toner (20 g) was placed in an open container, and left for 24 hours in a thermoregulated chamber at 45° C. and 80% humidity or at 50° C. and 80% humidity. Then, the externally added toner was evaluated according to the following criteria.

Good: The shape of the toner particles is maintained.

Slightly poor: A few toner lumps are observed.

Poor: Toner lumps are formed or the toner particles are shrunk.

Overall Evaluation Results

Based on the evaluation results of the respective evaluation items (charge stability, a difference between the decolorizing temperature and the lowest fixing temperature (ΔT), image density, and storage stability), the evaluation was performed according to the following criteria.

S: The case which was rated the highest grade for all the evaluation items.

A: The case which was rated "good" or a higher grade for all the evaluation items except for the above case rated "S".

B: The case which was not rated "poor" but was rated "slightly poor" for at least one evaluation item.

C: The case which was rated "poor" for at least one evaluation item.

The evaluation results and the overall evaluation result of each toner are shown in Table 2.

TABLE 2

| | Charge stability | Lowest fixing temperature | Decolorizing temperature | Difference between decolorizing temperature and lowest fixing temperature (ΔT) | Image density | Storage stability | Overall evaluation result |
|---|---|---|---|---|---|---|---|
| Example 1 | GOOD | 85 | 100 | 15 (GOOD) | 0.69 (VERY GOOD) | GOOD | A |
| Example 2 | GOOD | 89 | 100 | 11 (GOOD) | 0.62 (GOOD) | GOOD | A |
| Comparative Example 1 | GOOD | 91 | 100 | 9 (POOR) | 0.59 (GOOD) | GOOD | C |
| Example 3 | GOOD | 80 | 100 | 20 (VERY GOOD) | 0.69 (VERY GOOD) | GOOD | S |
| Example 4 | GOOD | 80 | 100 | 20 (VERY GOOD) | 0.46 (GOOD) | GOOD | A |
| Example 5 | GOOD | 85 | 100 | 15 (GOOD) | 0.46 (GOOD) | GOOD | A |
| Example 6 | GOOD | 90 | 100 | 10 (GOOD) | 0.43 (SLIGHTLY POOR) | GOOD | B |
| Comparative Example 2 | POOR | 74 | 100 | 26 (VERY GOOD) | 0.7 (VERY GOOD) | SLIGHTLY POOR | C |
| Example 7 | GOOD | 75 | 100 | 25 (VERY GOOD) | 0.65 (VERY GOOD) | GOOD | S |
| Example 8 | GOOD | 81 | 100 | 19 (GOOD) | 0.69 (VERY GOOD) | SLIGHTLY POOR | B |
| Example 9 | GOOD | 85 | 100 | 15 (GOOD) | 0.62 (GOOD) | SLIGHTLY POOR | B |
| Example 10 | SLIGHTLY POOR | 85 | 100 | 15 (GOOD) | 0.69 (VERY GOOD) | GOOD | B |
| Comparative Example 3 | POOR | 91 | 100 | 9 (POOR) | 0.59 (GOOD) | POOR | C |

As shown in Table 2, all the toners of Examples in which the amount of the binder resin is in the range of 60 to 80% by mass with respect to the total amount of the toner components were rated a higher grade for the overall evaluation than the toners of Comparative Examples. Further, the toners of Examples 3 and 7 in which the amount of the binder resin is in the range of 60 to 70% by mass with respect to the total amount of the toner components have more excellent color developability and low-temperature fixability than the toners of the other Examples, and were rated the highest grade for all the evaluation items. The toners of Examples 1 to 7 and 10 in which the glass transition temperature of the binder resin is 54° C. or higher have more excellent storage stability than the toners of Examples 8 and 9 in which the glass transition temperature of the binder resin is lower than 54° C. Further, the toners of Examples 1 to 7 have excellent charge stability since the state of coating the surface of the toner with the resin is favorable. The toners of Examples in which the amount of the colorant particles contained in the toner is 10% by mass or more have a high image density.

When the amount of the binder resin contained in the toner was reduced, the color developability and the low-temperature fixability of the toner were hardly improved while maintaining the charge stability and the storage stability of the toner. However, as described in detail above, according to the technique described in this specification, a decolorizable toner having improved color developability and low-temperature fixability while maintaining the charge stability and the storage stability of the toner can be provided.

While certain embodiments have been described, these embodiments have been presented by way of example only, and are not intended to limit the scope of the inventions. Indeed, the novel toner described herein may be embodied in a variety of other forms; furthermore, various omissions, substitutions and changes in the form of the toners and methods described herein may be made without departing from the spirit of the inventions. The accompanying claims and their equivalents are intended to cover such forms or modifications as would fall within the scope and spirit of the inventions.

What is claimed is:

1. A method for producing an electrophotographic toner comprising:

mixing a dispersion of colorant particles comprising a colorant and a dispersion of release agent particles consisting essentially of a release agent and having a volume average particle diameter smaller than that of the colorant particles;

aggregating the colorant particles and the release agent particles in the dispersion of the colorant particles and the release agent particles to produce first aggregates;

mixing the dispersion comprising the first aggregates and a dispersion of resin particles consisting essentially of a binder resin and having a volume average particle diameter smaller than that of the colorant particles; and aggregating the first aggregates and the resin particles in the dispersion of the first aggregates and the resin particles to produce second aggregates, wherein the release agent particles are disposed outside the colorant particles in each of the first aggregates, a surface of the first aggregates is coated by the resin particles in each of the second aggregates, and the binder resin is contained in an amount of 60 to 80% by mass with respect to the total amount of the colorant particles, the release agent particles and the binder resin.

2. The method according to claim 1, wherein the colorant particles comprise a color developable compound, a color developer and a decolorizing agent having an action of decolorizing by reducing an interaction between the color developable compound and the color developer and have a capsule structure coated with an outer shell.

3. The method according to claim 1, wherein the release agent is wax.

4. The method according to claim 1, wherein the colorant particles in the dispersion of colorant particles have a volume average particle diameter of 0.5 μm to 7 μm.

5. The method according to claim 1, wherein the colorant particles in the dispersion of colorant particles have a volume average particle diameter of 0.7 μm to 5 μm.

6. The method according to claim 1, wherein the resin particles in the dispersion of resin particles have a volume average particle diameter of 0.01 μm to 1.0 μm.

7. The method according to claim 1, wherein the resin particles in the dispersion of resin particles have a volume average particle diameter of 0.05 μm to 0.2 μm.

8. The method according to claim 1, wherein the colorant particles are contained in an amount of 10% by mass or more with respect to the total amount of the colorant particles, the release agent particles and the binder resin.

9. The method according to claim 1, wherein the colorant particles are contained in an amount of 15% by mass or more with respect to the total amount of the colorant particles, the release agent particles and the binder resin.

10. The method according to claim 1, wherein the release agent particles are contained in an amount of 10% by mass or more with respect to the total amount of the colorant particles, the release agent particles and the binder resin.

11. The method according to claim 1, wherein the binder resin is contained in an amount of 60 to 70% by mass with respect to the total amount of the colorant particles, the release agent particles and the binder resin.

12. The method according to claim 1, wherein the binder resin has a glass transition temperature of 54° C. to 70° C.

* * * * *